US007971374B2

(12) United States Patent
Hernandez

(10) Patent No.: US 7,971,374 B2
(45) Date of Patent: Jul. 5, 2011

(54) APPARATUS FOR USE IN FOOTWEAR AND THE LIKE

(76) Inventor: Peter J. Hernandez, Visalia, CA (US)

( * ) Notice: Subject to any disclaimer, the term of this patent is extended or adjusted under 35 U.S.C. 154(b) by 955 days.

(21) Appl. No.: 11/789,668

(22) Filed: Apr. 24, 2007

(65) Prior Publication Data

US 2008/0263893 A1 Oct. 30, 2008

(51) Int. Cl.
*A43B 5/00* (2006.01)

(52) U.S. Cl. ..... 36/94; 36/67 R; 36/134; 36/129

(58) Field of Classification Search ..... 36/94, 67 R, 36/134, 126–129
See application file for complete search history.

(56) References Cited

U.S. PATENT DOCUMENTS

| | | | | | |
|---|---|---|---|---|---|
| 2,902,780 | A * | 9/1959 | Bellew | 36/134 |
| 3,013,564 | A * | 12/1961 | Levey | 36/170 |
| 3,327,411 | A * | 6/1967 | Roberts | 36/134 |
| 3,967,390 | A * | 7/1976 | Anfruns | 36/94 |
| 4,135,317 | A * | 1/1979 | Ikeda | 36/134 |
| 4,212,120 | A * | 7/1980 | Bowerman et al. | 36/129 |
| 4,748,753 | A * | 6/1988 | Ju | 36/127 |
| 5,913,592 | A * | 6/1999 | Moore | 36/8.1 |
| 6,341,433 | B1 * | 1/2002 | Nakamura | 36/67 R |
| 6,935,055 | B2 * | 8/2005 | Oorei | 36/129 |
| 6,954,998 | B1 * | 10/2005 | Lussier | 36/107 |
| 7,082,703 | B2 * | 8/2006 | Greene et al. | 36/89 |
| 2003/0172555 | A1 * | 9/2003 | Chu | 36/113 |
| 2005/0166427 | A1 * | 8/2005 | Greene et al. | 36/128 |
| 2007/0144039 | A1 * | 6/2007 | Fliri | 36/94 |

* cited by examiner

*Primary Examiner* — Marie Patterson
(74) *Attorney, Agent, or Firm* — Worrel & Worrel

(57) ABSTRACT

An apparatus for use in footwear and the like, the apparatus having a primary body adapted to be mounted on a work object operable to perform a task; and at least two secondary bodies mounted on the primary body and adapted selectively to be moved by the work object in the performance of the task.

3 Claims, 2 Drawing Sheets

APPARATUS FOR USE IN FOOTWEAR AND THE LIKE

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION (1) Field of the Invention

The present invention relates to an apparatus for use in footwear and the like and, more particularly, to such an apparatus which has particular utility when embodied in footwear where it provides a plurality of unique qualities.

(2) Description of the Prior Art

It is well known that a wide variety of types of footwear and the like are used in everyday wear as well as in other activities. They are available in prolific numbers and in a wide range of types and forms of construction as well as for a multiplicity of activities.

For example, footwear of lightweight and flexible construction is, for these very qualities and others, unusually comfortable to wear and therefore in wide usage. For these reasons and others, footwear of generally similar characteristics is also widely used in athletic activities. It is self-evident that the lightweight nature of such footwear, or shoes, affords a competitive advantage in many sports. Similarly, the flexibility of such shoes aids, to some degree, in providing a comparatively good traction and other gripping characteristics as well as to rapid adjustment in direction various supporting surfaces. Simply for purposes of illustration, footwear and shoes of this general character are widely used in sports such as football, basketball, baseball, soccer and running sports, track and field events, golf and many other such competitive activities.

The market for footwear and shoes of this general type has been extensive for the above-noted reasons and others for a significant period of time. However, such conventional shoes have not appreciably been improved over this period. In point of fact, such shoes have been lacking in many respects, particularly in athletic usages. For example, the flexibility, traction and gripping characteristics of such shoes are limited in various respects. This creates not only a limitation on the wearer's performance, but can be hazardous. Slipping due to a loss of traction interferes with maneuverability in such activities. The ability to achieve a pivoting motion is similarly limited due to insufficient gripping characteristics, traction and the like. This factor proves deleterious in a multitude of usages. In otherwords, overall maneuverability is negatively affected by these limitations.

This is particularly true in track and field sports, such as sprints, distance events, long jump, standing long jump, high jump and pole vault. Such considerations as flexibility, traction, gripping ability and maneuverability, if lacking or otherwise limited, can mean a substantial difference in overall performance.

Therefore, it has long been known that it would be desirable to have an apparatus for use in footwear and the like which provides enhanced performance; which has particular utility when embodied in a shoe; which has improved capabilities in flexibility, gripping characteristics, traction and maneuverability; which is both comfortable and durable in use; which affords a superior capability for traction on a supporting surface regardless of the composition of the supporting surface; which permits the wearer to have an improved degree of control over the amount and character of the gripping characteristics; and which is otherwise successful in achieving its operational objectives.

BRIEF SUMMARY OF THE INVENTION

Therefore, it is an object of the present invention to provide an improved apparatus for use in footwear and the like which can be used in a multitude of operative environments.

Another object is to provide such an apparatus which has particular utility as applied to the configuration and construction of shoes of a multiplicity of types.

Another object is to provide such an apparatus which substantially improves upon the traction, gripping characteristics and flexibility possible in conventional shoe construction.

Another object is to provide such an apparatus which possesses a degree of comfort when worn superior to that which has heretofore been achieved.

Another object is to provide such an apparatus which has particular utility when embodied in athletic shoes, whether worn for everyday use, or in athletic training and competition.

Another object is to provide such an apparatus which can be used in a wide variety of types of athletic competition such as, but not limited to, track and field sports, football, basketball, soccer, golf and many other such sports.

Another object is to provide such an apparatus which can readily be adapted to other uses and activities including, for example, but not limited to, mountain climbing; swimming; underwater usages; water polo; automobile, boat and motorcycle racing; sprint and distance running; and many other usages.

Another object is to provide such an apparatus which is capable of such a wide variety of applications with little or no modification for the particular activity, or activities, in which they are to be used.

Another object is to provide such an apparatus which can be manufactured and sold at minimal expense while retaining all of the benefits achieved in more expensive forms thereof.

Another object is to provide such an apparatus which employs human anatomy in a manner which substantially enhances the capabilities thereof without negative consequences.

Further objects and advantages are to provide improved elements and arrangements thereof in an apparatus for the purposes described which is dependable, economical, durable and fully effective in accomplishing its intended purposes.

These and other objects and advantages are achieved, in the preferred embodiment of the present invention, in an apparatus for use in footwear and the like, the apparatus having a primary body adapted to be mounted on a work object operable to perform a task; and at least two secondary bodies mounted on the main body and adapted selectively to be moved by the work object in the performance of the task.

DETAILED DESCRIPTION OF THE INVENTION

Figure 1:
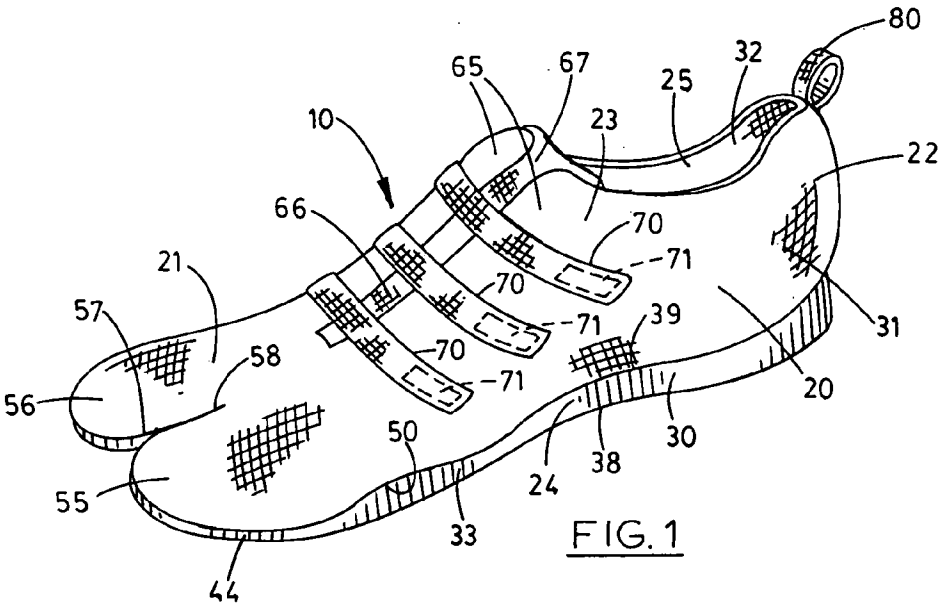
FIG. 1 is a perspective view of the preferred embodiment of the apparatus for use in footwear and the like of the present invention.

Referring more particularly to the drawings, the apparatus for use in footwear and the like of the present invention in generally indicated by the numeral 10 in FIG. 1.

It will be understood that the specific apparatus of the present invention shown in the drawings and described herein is, for illustrative convenience, footwear and, more particularly, an athletic shoe. More specifically, the athletic shoe shown and described herein is one intended primarily for use in track and field training and competition. However, the apparatus of the present invention can be embodied in a wide variety of different types of footwear, shoes and other objects including, but not limited to, shoes intended for everyday use, golf, mountain and rugged terrain shoes, shoes for racing drivers, shoes for boat and water usages, skin diver's footwear, swim fins, ski boots, snow boarding boots, shoes to be used by aircraft pilots, shoes for military usage and many other apparatuses, articles and objects.

As noted, the apparatus 10 of the preferred embodiment shown and described herein is adapted primarily for track and field usage in athletic training and competition. For this reason, in the preferred embodiment, the apparatus is constructed of lightweight, flexible and breathable materials. For illustrative convenience, the apparatus in the preferred embodiment is described in this specification as a primary body or shoe 10.

The shoe 10 can generally be viewed as having a primary body or shoe body 20 with a forward portion 21 and an opposite rearward portion 22. The shoe body has an upper portion 23 and an opposite lower portion 24. An access opening 25 is provided in the upper portion of the shoe body through which the wearer's foot, not shown, is inserted into the shoe, or removed therefrom, as will hereinafter be described in greater detail.

More specifically, the shoe body 20 has a sole 30 on which is mounted an upper 31. The sole is preferably constructed of a tractable, flexible material. The shoe body has an interior 32 adapted generally to conform to the foot of the wearer. The specific shoe, as shown and described herein, is to be worn on the left foot of the wearer and, of course, be of a size and shape appropriate for the size and shape of the left foot of the wearer. A corresponding shoe, not shown, is adapted to be worn on the right foot of the wearer and otherwise corresponds to the shoe 10 except for the difference in accommodating, or fitting the right foot.

The sole 30 of the shoe body 20 has a left marginal surface 33 and a laterally opposite right marginal surface 34. The sole has a bottom surface 38 preferably constructed of a cushioned plastic, or rubberized, material which is tractable so as to provide the desired degree of traction, comfort and performance. The sole has a top surface 39 which can be covered in the interior 32 of the shoe body with a cushioned liner 40 for purposes of comfort and shock absorption.

The sole 30 has a leading surface 41 and an opposite trailing surface 42. The sole has a heal portion 43 and an opposite toe portion 44.

The upper 31 is mounted on the sole 30 along a boarder 50 extending entirely about the periphery thereof. The upper is mounted on the sole along the boarder by any suitable means, not shown, such as stitching, bonding, or the like or any combination thereof.

Figure 2:
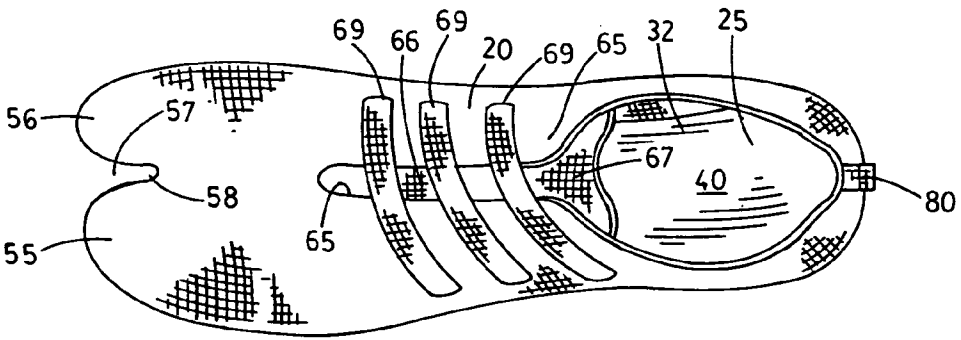
FIG. 2 is a top plan view of the apparatus of FIG. 1.
Figure 3:
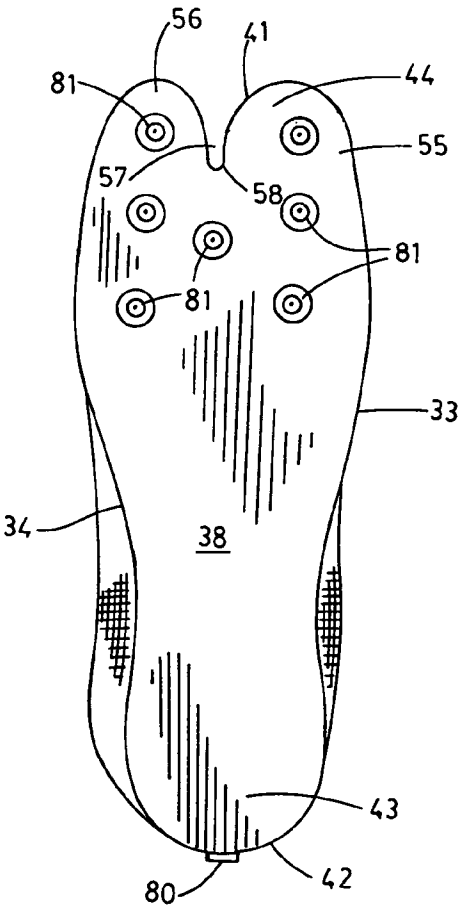
FIG. 3 is a bottom plan view thereof.

The forward portion 21 of the shoe body 20 together with the toe portion 44 of the sole 30 are bifurcated, as perhaps best shown in FIGS. 1, 2 and 3, to form a secondary body or forward housing 55 and an adjoining secondary body or forward housing 56. The interior 32 of the shoe body includes individual compartments or spaces, not shown, defined and bounded by the forward housing 55 and forward housing 56. The compartment of the forward housing 55 is dimensioned comfortably to contain a forward portion of the human foot and the four (4) smaller toes thereof, other than the big toe of the foot. The compartment of the forward housing 56 is dimensioned comfortably to contain a forward portion of the human foot and the big toe thereof. The forward housing 55 is consequently somewhat wider than the forward housing 56. The forward housing 55 and the forward housing 56 of the forward portion 21 of the shoe body 20 are separated from each other by a channel 57 which extends into the forward portion 21 to a terminus 58. The terminus preferably is rounded so as to form an arc like configuration, as best shown in FIGS. 2 and 3.

Thus, when the shoe 10 is worn, as discussed regarding the representative left foot, the four (4) smaller toes are received in the compartment of the forward housing 55 and the big toe of the left foot is received in the compartment of the forward housing 56. The shoe 10 constructed, in accordance with the subject invention, for the right foot of the wearer is the reverse of that heretofore described; that is the forward housing 55 is on the right relative to the right shoe 10 and the forward housing 56 is on the left relative to the right shoe 10. The left and the right shoes 10 each have the channel 57 extending between the respective smaller toes and big toe.

In view of the narrow thickness of the toe portion 44 of the sole 30 and the flexibility of the shoe body, the forward housing 55 and the forward housing 56 of the forward portion 21 of the shoe body 20 are individually movable upwardly and/or downwardly relative to each other. This is achieved by the smaller toes of the wearer within the forward housing 55 and the big toe of the wearer in the forward housing 56 being moved upwardly and/or downwardly relative to each other. Alternatively, the wearer can move both the smaller toes and the big toe together either upwardly or downwardly.

Figure 5:
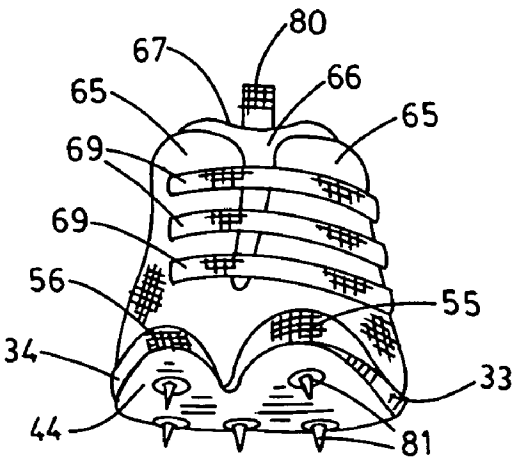
FIG. 5 is a front elevation thereof.

As perhaps best shown in FIGS. 1, 2 and 5, the upper portion 23 of the shoe body 20 has opposed upper flap portions 65 which bound a channel 66 therebetween. This makes possible the lateral expansion of the shoe body for receiving or removing the foot of the wearer. The shoe body has a tongue 67 beneath the upper flap portions and channel.

The shoe body 20, in the embodiment shown and described herein, has three (3) straps 68 which extend across the upper flap portion 65 of the shoe body for the purpose of securing the shoe body in properly fitted relation to the foot of the wearer. The straps are also employed to release the upper flap portions for removal of the wearer's foot from the shoe body. Each strap has an attached end portion 69 permanently attached to one of the upper flap portions 65 and an opposite securing end portion 70. "Velcro" fasteners 71 are mounted on the securing end portion of each strap disposed for adjustable engagement with the other portion of the "Velcro" fastener which is composed of two portions. One portion is mounted on the upper portion 23 of the shoe body. The other portion of the "Velcro" fasteners is mounted on the securing end portion 70 of each strap 68.

Figure 4:
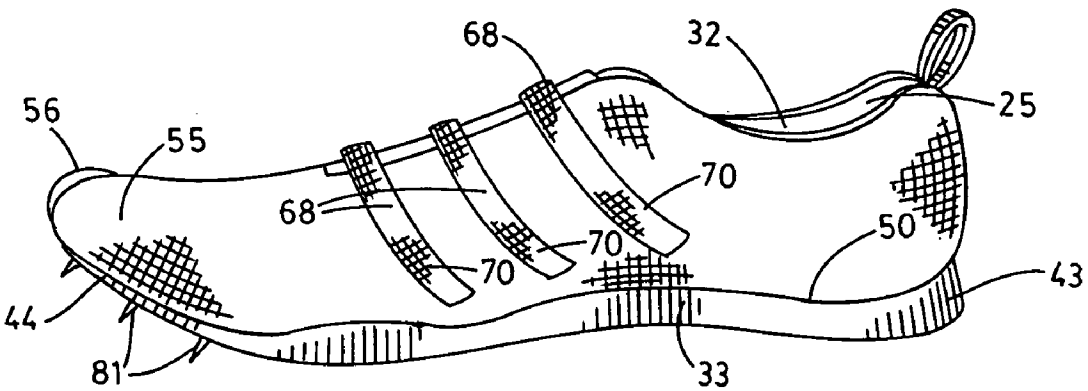
FIG. 4 is a side elevation thereof showing the left side thereof.
Figure 6:
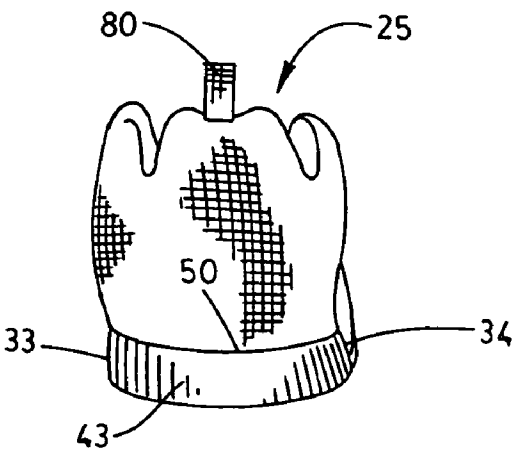
FIG. 6 is a rear elevation thereof.

A grasping loop 80 is mounted on the rearward portion 22 of the shoe body 20 for assistance in pulling on, or alternatively pulling off the shoe 10. As shown in FIGS. 3, 4 and 5 a plurality of spike assemblies 81 are mounted on the bottom surface 38 of the toe portion 44 of the sole 30. In the preferred embodiment of the shoe 10, the spike assemblies are removable and capable of being replaced with different types of spike assemblies, can be left off entirely, or used in any preferred combination. The spike assemblies can be used in any desired pattern extending over the bottom surface of the sole. This is dependent upon the specific use intended for the shoe, the particular sport involved and the preference of the wearer.

Operation

The operation of the described embodiment of the subject invention is believed to be readily apparent and is briefly summarized at this point.

As previously discussed, in the preferred embodiment of the invention, the apparatus is embodied in the shoe 10 as shown in the drawings. The shoe, or rather left and right shoes embodying the apparatus, are placed on the respective left and right feet of the wearer. This is achieved, in each case, by releasing the straps 68 from their respective "Velcro" fasteners 71. This frees the upper flap portions 65 of each shoe to be moved from each other and the tongue 67 to be lifted. This, in turn, opens the interior 32 of each shoe body 20 for the insertion of the left or right foot, as appropriate, of the wearer or, conversely, the removal of each foot from its respective shoe.

During insertion of each foot in its respective shoe, the big toe of the foot is inserted in the interior of the forward housing 56 and the four (4) smaller toes are inserted in side-by-side relation in the forward housing 55. Thus, the big toe is separated from the four (4) smaller toes by being on opposite sides of the channel 57 to the point of the terminus 58 thereof. The big toe and the four (4) smaller toes of each foot and the ball of each foot are directly over the spike assemblies 81, as best shown in FIG. 3.

Using the grasping loop 80, as necessary, the shoe body 20 is pulled fully on to the foot so that the foot is fully received in the interior 32 of its respective shoe. The tongue 67 is lowered into rested engagement with the upper surface of the foot, or sock worn on the foot, so as to be comfortable. The upper flap portions 65 are then drawn toward each other using the straps 68 and the securing end portions fastened in place using the "Velcro" fasteners 71, as shown in FIGS. 1, 2, 4 and 5. The straps are drawn tightly enough for securing by the "Velcro" fasteners for the particular activity to be performed using the shoes such as, for example, track and field training or competition.

As previously discussed, the forward housings 55 and 56 respectively can be moved up or down together or independently of each other with the forward portion 21 and toe portion 44 of the sole 30 providing sufficient flexibility to accommodate such movement. Because of this flexibility, the forward housings 55 and 56 can be manipulated by the wearer's toes to grip a surface, or other object therebeneath. This gripping effect permits the wearer to have a significant advantage by superior traction and gripping ability over prior art shoes not having this ability. In addition, the wearer has these capabilities together with the use of the spike assemblies 81 to enhance the gripping ability, traction and rapid maneuverability.

Still further, the application of this gripping ability can be varied to suit the circumstances entirely under the control of the wearer. Thus, for example, in football and soccer the traction sufficient to achieve a sudden change of direction is entirely under the control of the wearer. Similarly, in track and field training and competition, the degree of application of this gripping ability, for example, may be greater at the start of a race than during the remainder of the race. In high jump and pole vaulting the specific time and degree of such traction can be essential to success. In long jump the degree and timing of traction can be all important.

There are many other examples and environments where the degree and control of such traction can be sited. Just to identify one such different environment of use, with the removal of the spike assemblies, the shoes can with little or no other modification be used to advantage in basketball.

Therefore, the apparatus for use in footwear and the like provides enhanced performance; has particular utility when embodied in a shoe; has improved capabilities in flexibility, gripping characteristics, traction and maneuverability; is both comfortable and durable in use; affords a superior capability for traction on a supporting surface regardless of the composition of the supporting surface; permits the wearer to have an improved degree of control over the amount and character of the gripping characteristics; and is otherwise successful in achieving its operational objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus for use in footwear and the like, the apparatus comprising a shoe body having a sole, an upper portion and a forward portion and adapted to be worn on the foot of a user having movable toes and a ball of the foot on the underside of the foot adjacent to said movable toes; a first housing on the forward portion of the shoe body dimensioned to receive one of said movable toes, said first housing being an extension of said forward portion of the shoe body and said sole; a second housing mounted on the forward portion of the shoe body dimensioned to receive the remainder of said movable toes, the second housing being an extension of said forward portion of the shoe body and said sole, and the first housing and the second housing being separated from each other by a channel so that the first housing and second housing are movable relative to each other and the shoe body; and spikes mounted on the underside of said sole of said first housing and said second housing on opposite sides of the channel and a plurality of spikes mounted on the underside of said sole beneath said ball of the foot and wherein the sole beneath said first housing and said second housing is of less thickness than the thickness of the remainder of said sole to facilitate movement of the first housing and the second housing permitting the user to move the first housing and said second housing independently of each other and said plurality of plurality of spikes mounted on the underside of said sole beneath said ball of the foot under the impetus of the movable toes of the users foot therein to control the grip thereof and the application of said spikes.

2. The apparatus of claim 1 wherein said channel between the first housing and second housing terminates in a rounded configuration whereby movement of the first housing and second housing relative to each other is facilitated.

3. The apparatus of claim 2 wherein said spikes are removable so as to adapt the apparatus for a variety of usages.

* * * * *